US007991324B2

(12) United States Patent
Takagi

(10) Patent No.: US 7,991,324 B2
(45) Date of Patent: Aug. 2, 2011

(54) PHOTOSENSITIVE UNIT AND IMAGE FORMING APPARATUS

(75) Inventor: Osamu Takagi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 744 days.

(21) Appl. No.: 11/741,211

(22) Filed: Apr. 27, 2007

(65) Prior Publication Data

US 2007/0253729 A1 Nov. 1, 2007

(30) Foreign Application Priority Data

Apr. 28, 2006 (JP) ..... 2006-125879

(51) Int. Cl.
*G03G 15/00* (2006.01)

(52) U.S. Cl. ..... 399/117; 399/107; 399/116; 399/159; 399/167

(58) Field of Classification Search ..... 399/107, 399/110, 111, 116, 117, 159, 167
See application file for complete search history.

(56) References Cited

U.S. PATENT DOCUMENTS

| | | | | |
|---|---|---|---|---|
| 5,570,160 | A * | 10/1996 | Miwa et al. | 399/116 |
| 5,739,900 | A * | 4/1998 | Isobe | 355/109 |
| 5,895,145 | A * | 4/1999 | Yamada | 399/116 |
| 6,067,429 | A * | 5/2000 | Sugaya et al. | 399/167 |
| 6,366,748 | B1 * | 4/2002 | Takeuchi et al. | 399/111 |
| 2002/0057928 | A1 * | 5/2002 | Yasumoto et al. | 399/167 |
| 2005/0158077 | A1 | 7/2005 | Kwon | |

FOREIGN PATENT DOCUMENTS

JP 2005208654 8/2005

* cited by examiner

*Primary Examiner* — David P Porta
*Assistant Examiner* — Jessica L Eley
(74) *Attorney, Agent, or Firm* — Banner & Witcoff, Ltd.

(57) ABSTRACT

A photosensitive unit is described. The photosensitive unit may include a side wall; a drum body rotatably provided with respect to the side wall and formed with an electrostatic latent image; a brake member provided on one end portion of the drum body in an axial direction and having a brake-side inclined surface whose diameter is gradually enlarged or reduced along the axial direction with an axis of the drum body as a center; and an urging member having an urging-side inclined surface surface-contacting the brake-side inclined surface and urging the brake member such that the urging-side inclined surface surface-contacts the brake-side inclined surface.

20 Claims, 8 Drawing Sheets

PHOTOSENSITIVE UNIT AND IMAGE FORMING APPARATUS

CROSS REFERENCE TO RELATED APPLICATION

This application claims priority based on Japanese Patent Application No. 2006-125879, filed on Apr. 28, 2006, the disclosure of which is herein incorporated by reference.

TECHNICAL FIELD

Aspect of the present invention relate to an image forming apparatus such as a laser printer and a photosensitive unit equipped in the image forming apparatus.

BACKGROUND

In a photosensitive unit equipped in an image forming apparatus such as a laser printer, a driving force from an image forming apparatus body is transmitted to a drum body of a photosensitive drum which receives laser from an exposing unit and is formed with an electrostatic latent image, through the driving force transmission mechanism such as a gear disposed at the axial end portion of the drum body. Additionally, a developing roller for supplying toner to the drum body is disposed so as to be in press contact with the drum body, and a driving force from the image forming apparatus body is transmitted to the developing roller through the driving force transmission mechanism disposed at the axial end portion thereof. Thereafter, the driving force is transmitted to rotate the drum body and the developing roller, the toner is fed to the electrostatic latent image on the drum body to form a toner image on the drum body, and the toner image is then transferred onto the sheet.

In such image forming apparatus, the rotational speed of the developing roller is generally set higher than the rotational speed of the drum body for smoothly supplying toner to the drum body. Therefore, the rotational torque that corresponds to the difference between the rotational speeds acts on the drum body, which may increase the rotational speed of the drum body. Additionally, when a gear is employed as the driving force transmission mechanism described above, a backlash from the gear may change the rotational speed of the drum body.

Such problems may cause a shift in the timing of receiving laser beam and the timing of transferring the toner image from the drum body onto the sheet, in the drum body, resulting in an image shift in the rotational direction of the drum body during image formation.

A structure is therefore proposed to maintain the constant-speed rotation of the drum body by controlling a change in the rotational speed of the drum body.

As a structure for maintaining the constant-speed rotation of the drum body, for example, a structure having a frame inside the image forming apparatus, a photosensitive body and a dumping mechanism is known. The photosensitive body is rotatably connected to the frame via the rotation shaft thereof. A dumping mechanism includes a pressurizing member through which the rotation shaft of the photosensitive body extends and which has a friction pad attached on a surface opposed to a flange at the end portion of the photosensitive body; and a coil spring through which the rotation shaft of the photosensitive body extends and which urges the pressurizing member toward the flange of the photosensitive body. With this structure, elastic pressure of the friction pad is applied to the flange at the end portion of the photosensitive body, thereby giving a frictional force to the rotation of the photosensitive body and restricting the above described changes in the speed.

A structure for maintaining constant-speed rotation has been proposed. In this structure, a damper having a core through which the rotation shaft of the photosensitive body extends and a pair of wings extending from the external peripheral portion of the core, is placed in a recessed groove portion formed between a first circular projection portion and a second circular projection portion provided in the flange of the photosensitive body, and the wings of the dumper contact the internal surface of the first circular projection portion of the photosensitive body during the rotation of the photosensitive body to apply frictional force to the rotation of the photosensitive body.

However, there is a limit in securing a contact area of the flange and the pressurizing member since the coil spring urges the pressurizing member toward the flange along the axial direction of the photosensitive body and the contact surface of the friction pad of the pressurizing member and the flange are orthogonal to the urging direction of the coil spring (axial direction of the photosensitive body). This may also limit the magnitude of the frictional force applied to the rotation of the photosensitive body.

On the other hand, in the latter structure for maintaining the constant-speed rotation, as a rotation prevention unit to prevent the simultaneous rotation of the dumper and the flange, it is necessary to form a stopper in the dumper and form a stopper accommodation groove for accommodating the stopper in the frame, leading to a complex structure.

In conventional constant speed rotation maintaining structures including the above-described structures, although some effects have been recognized for maintaining the constant speed rotation in black and white laser printers that have one photosensitive body, it may not be able to maintain an adequate level of the constant speed rotation in color laser printers that have a plurality of photosensitive bodies, since an image shift may be caused due to a shift in the transferring timing onto the sheet in the case where the printer even slightly fails to maintain the constant speed rotation between the photosensitive bodies.

Further, in an image forming apparatus in which a rotation shaft is provided unrotatably with respect to the frame and a photosensitive body is provided rotatably with respect to the rotation shaft, a slight gap (50 μm in diametric difference, for example) is uniformly secured in the radial direction on the periphery of the rotation shaft between the photosensitive body and the rotation shaft since the photosensitive body slides with respect to the rotation shaft. Therefore, if a frictional force generated in the constant speed rotation maintaining structure does not act uniformly upon the rotational direction with respect to the rotation of the photosensitive body, the gap between the photosensitive body and the rotation shaft will not be uniform on the periphery of the rotation shaft and thus the rotation of the photosensitive body is decentered. The decentered rotation of the photosensitive body leads to an image shift caused by a change of the photosensitive body in the radial direction with respect to the rotation shaft.

SUMMARY

One aspect of the present invention may provide a photosensitive unit which can reliably maintain the constant speed rotation of the drum body and can reliably prevent the image shift by a simple configuration, and to provide an image forming apparatus equipped with the photosensitive unit.

The same or different aspect of the present invention may provide a photosensitive unit including: a side wall; a drum body rotatably provided with respect to the side wall and formed with an electrostatic latent image; a brake member provided on one end portion of the drum body in an axial direction and having a brake-side inclined surface whose diameter is gradually enlarged or reduced along the axial direction with an axis of the drum body as a center; and an urging member having an urging-side inclined surface surface-contacting the brake-side inclined surface and urging the brake member such that the urging-side inclined surface surface-contacts the brake-side inclined surface.

One or more aspects of the present invention provide an image forming apparatus including: an image forming apparatus body; a photosensitive unit being detachably mountable to the image forming apparatus body and including a side wall, a drum body rotatably provided with respect to the side wall and formed with an electrostatic latent image, a brake member provided on one end portion of the drum body in an axial direction and having a brake-side inclined surface whose diameter is gradually enlarged or reduced along the axial direction with an axis of the drum body as a center, an urging member having an urging-side inclined surface surface-contacting the brake-side inclined surface and urging the brake member such that the urging-side inclined surface surface-contacts the brake-side inclined surface, and a developing unit for forming a developing agent image by feeding a developing agent to the drum body and developing the electrostatic latent image; a transferring unit for transferring the developing agent image carried on the drum body and developed by the developing unit onto a transfer medium; and a fixing unit for fixing the developing agent image transferred onto the transfer medium on the transfer medium.

One or more aspects of the present invention provide an image forming apparatus including: an image forming apparatus body; a photosensitive unit including a side wall, a drum body rotatably provided with respect to the side wall and formed with an electrostatic latent image, a brake member provided on one end portion of the drum body in an axial direction and having a brake-side inclined surface whose diameter is gradually enlarged or reduced along the axial direction with an axis of the drum body as a center, an urging member having an urging-side inclined surface surface-contacting the brake-side inclined surface and urging the brake member such that the urging-side inclined surface surface-contacts the brake-side inclined surface, and a developing unit for forming a developing agent image by feeding a developing agent to the drum body and developing the electrostatic latent image; a transferring unit for transferring the developing agent image carried on the drum body and developed by the developing unit onto a transfer medium; and a fixing unit for fixing the developing agent image transferred onto the transfer medium on the transfer medium, wherein the photosensitive unit includes: a plurality of the drum bodies, a plurality of the brake members and a plurality of the urging members in a direction orthogonal to the axial direction of the drum body; and the photosensitive unit includes a plurality of the developing units corresponding to the respective drum bodies, and the plurality of drum bodies, the plurality of brake members and the plurality of urging members are together attached to and detached from the image forming apparatus body in a slidable manner.

DETAILED DESCRIPTION

First Embodiment

1. Overall Configuration of Color Laser Printer

Figure 1:
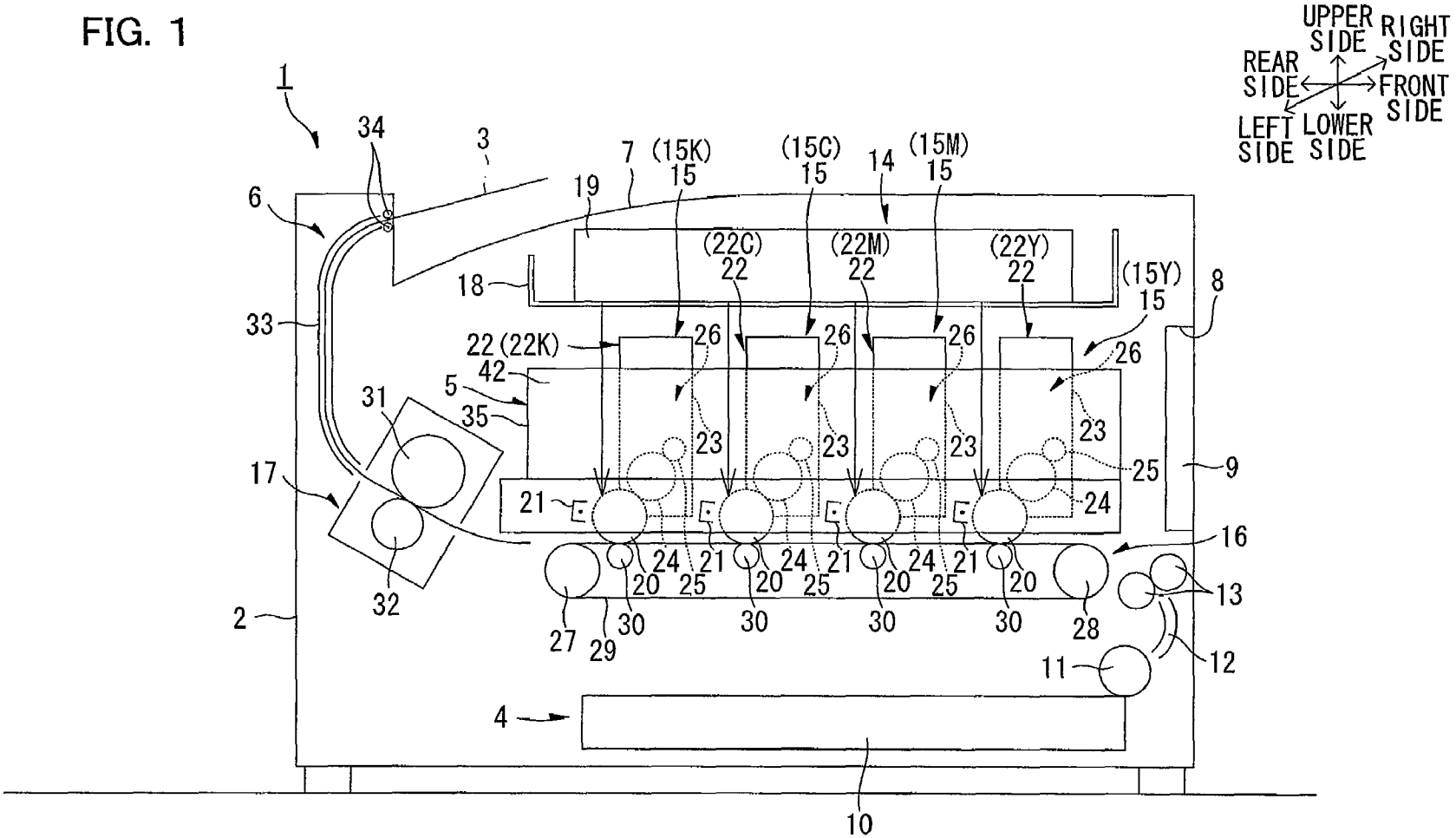
FIG. 1 is a sectional side view showing an illustrative aspect of a color laser printer as an example of an image forming apparatus of one or more aspects of the present invention.

FIG. 1 is a sectional side view showing an illustrative aspect of a color laser printer as an example of an image forming apparatus of one or more aspects of the present invention.

This color laser printer 1 is a horizontal tandem type color laser printer in which a plurality of processing sections 15 as examples of the photosensitive units are disposed in parallel in the horizontal direction, and includes a sheet feeding section 4 for feeding a sheet 3 as an example of a transfer medium, an image forming section 5 for forming an image onto the fed sheet 3, and a sheet ejecting section 6 for ejecting the sheet 3 on which the image has been formed, in a box shaped main body casing 2 as an example of an image forming apparatus body, as shown in FIG. 1.

(1) Main Body Casing

The main body casing 2 has an upper surface formed with a sheet ejecting tray 7 for receiving the sheet 3 formed with the image thereon. One side of the sheet ejecting tray 7 on the upper surface of the main body casing 2 is embedded with an operation panel (not shown) which includes operation keys and an LED display. In the main body casing 2, a front opening 8 is formed in a portion upward from the central portion in the vertical direction on the side wall on the side of the operation panel, and communicates the inside and the outside of the main body casing 2 with each other. A front cover 9 is provided on the front opening 8 for opening and closing the front opening 8. The front cover 9 is rotatably supported by a cover shaft (not shown) inserted through the lower end portion thereof. When the front cover 9 is closed with the cover shaft as a center, the front cover 9 blocks the opening 8, and when the front cover 9 is opened (tilted) with the cover shaft as a supporting point, the front opening 8 is opened.

In the following description, the side on which the front cover 9 is provided is referred to as a "front side" of the color laser printer 1, and the opposite side of the front side is referred to as a "rear side" of the color laser printer 1. The near side in sheet thickness direction in FIG. 1 is referred to as a "left side" and the far side in the sheet thickness direction in FIG. 1 is referred to as a "right side". In some cases, the direction to the right and left maybe referred to as a "width direction".

(2) Sheet Feeding Section

The sheet feeding section 4 includes a sheet cassette 10 provided on the bottom of the main body casing 2, a sheet feeding roller 11 provided above the front side of the sheet cassette 10, a sheet feeding transport path 12 provided above the front side of the sheet feeding roller 11, and a pair of resist rollers 13 provided at the downstream end portion of the sheet feeding transport path 12.

In the sheet cassette 10, sheets 3 are stacked and the uppermost sheet 3 is fed out to the sheet feeding transport path 12 by rotation of the sheet feeding roller 11. The transportation direction of the sheet 3 fed out to the sheet feeding transport path 12 is then reversed while transported through the sheet feeding transport path 12, resisted by the resist rollers 13, and then transported to a transfer positions between photosensitive drums 20 and a transport belt 29 which are described later.

(3) Image Forming Section

The image forming section 5 includes a scanning unit 14, a processing section 15, a transferring section 16 as an example of a transferring unit, and a fixing section 17 as an example of a fixing unit.

<Scanning Unit>

The scanning unit 14 is disposed in the upper portion of the main body casing 2 above across a plurality of the processing sections 15 described later. This scanning unit 14 includes a scanner frame 18 fixed to the main body casing 2 and a scanner casing 19 fixed to the scanner frame 18. Optical members such as four light sources, a polygonal mirror, an fθ lens, a reflecting mirror, and an optical face tangle error correction lens are disposed in the scanner casing 19. The light source emits laser beams based on image data. Thereafter, the beam is deflected and scanned by the polygonal mirror, passes through the fθ lens and the optical face tangle error correction lens, reflected by the reflecting mirror, and then irradiated by rapid scanning on the surface of the later described photosensitive drum 20 of each color in the processing section 15, as illustrated by the arrows in the accompanying drawings.

<Processing Section>

The processing sections 15 is provided corresponding to a plurality of color toners. Specifically, the processing section 15 includes four processing sections, that is, a yellow processing section 15Y, a magenta processing section 15M, a cyan processing section 15C, and a black processing section 15K. The four processing sections 15 are disposed in parallel in spaced relation with each other from the front toward the back. The four processing sections 15 are accommodated in a box-shaped process frame 35 with the upper surface thereof opened. When the front opening 8 of the main body casing 2 is opened and the process frame 35 is moved in the antero-posterior direction, the processing sections 15 are slidably attached to and detached from the main body casing 2.

Each processing section 15 includes a photosensitive drum 20, a scorotron charger 21, and a developer cartridge 22 as an example of a developing unit.

Figure 2:
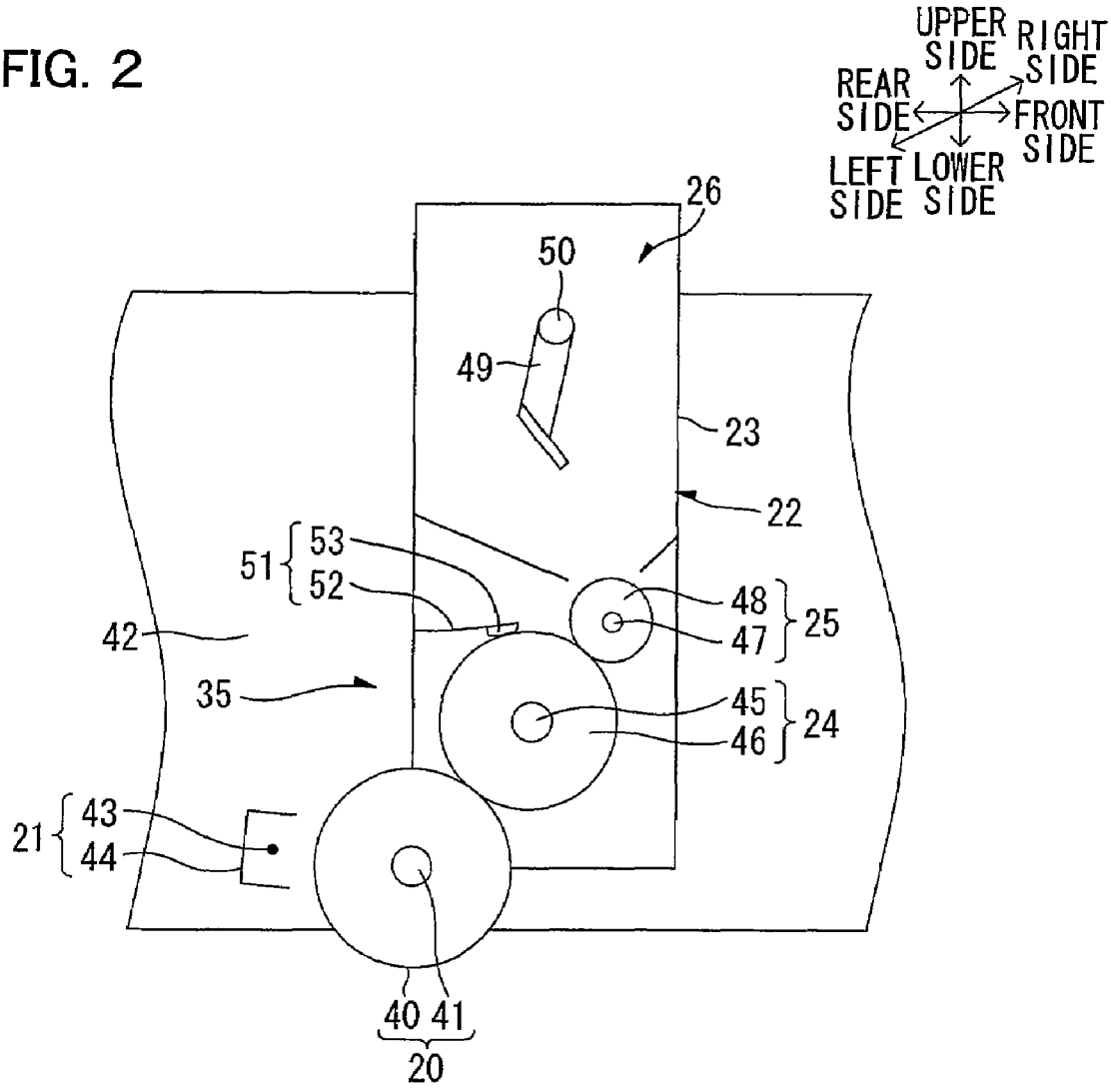
FIG. 2 shows one processing section drawn out from FIG. 1.

FIG. 2 shows one processing section drawn out from FIG. 1.

As shown in FIG. 2, the photosensitive drum 20 includes a drum body 40 formed in a hollow cylindrical shape with the outermost layer formed of a positively chargeable photosensitive layer such as polycarbonate, and a drum shaft 41 extending along the axial direction of the drum body 40 at the center of the axis of the drum body 40. The drum shaft 41 is supported unrotatably on both side walls 42 in the width direction of the process frame 35, and the drum body 40 is supported rotatably with respect to the drum shaft 41. The drum body 40 is rotatively driven in the clockwise direction by transmission of the driving force from a driving motor (not shown) of the main body casing 2 which is described later.

The scorotron charger 21 is positively chargeable, includes a wire 43 and a grid 44, generates corona discharge by applying charging bias, and disposed in opposed spaced relation with the photosensitive drum 20 so as not to contact the photosensitive drum 20 in the backside thereof.

The developer cartridge 22 is disposed above the front side of the photosensitive drum 20 and includes a casing 23, and a developing roller 24, a feed roller 25 and a layer-thickness regulating member 51 disposed in the casing 23.

The casing 23 is in a box shape with the lower end portion of the rear side thereof opened. The upper portion of the casing 23 is designed to be a toner accommodation chamber 26 which accommodates each color toner. Specifically, in the toner accommodation chamber 26 of a developer cartridge 22 of the yellow processing section 15Y (hereinafter referred to as a "yellow developer cartridge 22Y"), a positively chargeable non-magnetic single-component polymer toner having yellow color is accommodated, as shown in the FIG. 1. Similarly, in the toner accommodation chamber 26 of a developer cartridge 22M of the magenta processing section 15M, a magenta color toner is accommodated, in the toner accommodation chamber 26 of a developer cartridge 22C of the cyan processing section 15C, a cyan color toner is accommodated, and in the toner accommodation chamber 26 of a developer cartridge 22K of the black processing section 15K, a black color toner is accommodated.

The toner accommodation chamber 26 is provided with an agitator 49 for agitating the toner in the toner accommodation chamber 26, as shown in FIG. 2. The agitator 49 is rotatably supported by an agitator shaft 50 extending in the width direction in the central portion of the toner accommodation chamber 26. With this agitator shaft 50 as a supporting point, the agitator 49 rotates to agitate the toner in the toner accommodation chamber 26 and discharge the toner downward.

The developing roller 24 is opposed to the photosensitive drum 20 from obliquely upper front side and is brought into press contact with the photosensitive drum 20. In this developing roller 24, a metallic roller shaft 45 is covered with a roller portion 46 formed of an elastic member such as an electrically conductive rubber material. Moreover, this roller shaft 45 is rotatably supported on the both lateral side walls of the casing 23 and is applied with developing bias during image formation.

The feed roller 25 is opposed to the developing roller 24 from obliquely upper front side and brought into press contact with the developing roller 24. In this feed roller 25, a metallic roller shaft 47 is covered with a roller portion 48 formed of an electrically conductive sponge member. This roller shaft 47 is rotatably supported on the both lateral side walls of the casing 23.

The layer-thickness regulating member 51 includes a blade body 52 formed of a metallic blade spring material with a proximal edge thereof supported by the casing 23, and a pressing portion 53 which is semicircular-shape as seen in section and provided on the distal end of the blade body 52 and formed of insulative silicone rubber. In the layer-thickness regulating member 51, the pressing portion 53 is brought into press contact with the surface of the developing roller 24 on the rear side of the feed roller 25 by an elastic force of the blade body 52.

During image forming process, the toner accommodated in the toner accommodation chamber 26 of each processing section 15 is agitated by the agitator 49 and discharged downward to be fed to the feed roller 25, as described above. The toner is then fed to the developing roller 24 by the rotation of the feed roller 25. At this time, the toner is triboelectrically positively charged between the feed roller 25 and the developing roller 24 which is applied with developing bias. Along with the rotation of developing roller 24, the toner enters between the pressing portion 53 of the layer-thickness regulating blade 51 and the roller portion 46 of the developing roller 24 and carried as a thin layer having a fixed thickness on the roller portion 46 of the developing roller 24.

On the other hand, the scorotron charger 21 generates corona discharge by applying charging bias and thereby positively and uniformly charges the surface of the drum body 40 of the photosensitive drum 20. The surface of the drum body 40 is positively and uniformly charged by the scorotron charger 21 along with the rotation thereof, and then exposed to light by rapid scanning of the laser light emitted from an output window (not shown) of the scanning unit 14 (see FIG. 1), and an electrostatic latent image of each color corresponding to the image to be formed on the sheet 3 is formed.

With the further rotation of the drum body 40, the toner carried on the surface of the developing roller 24 and positively charged, is then fed to the electrostatic latent image formed on the surface of the drum body 40, that is, a portion exposed to light by laser light and having lower potential on the surface of the uniformly and positively charged drum body 40 when the toner opposingly contacts the photosensitive drum 20 by the rotation of the developing roller 24. Consequently, the electrostatic latent image on the drum body 40 is visualized, and the toner image corresponding to each color is carried on the surface of the drum body 40 by reversal developing. The rotational speed of the developing roller 24 is set higher than the rotational speed of the drum body 40 for smoothly supplying the toner to the drum body 40.

<Transferring Section>

The transferring section 16 is disposed above the sheet cassette 10 and below the processing section 15 along the anteroposterior direction in the main body casing 2, as shown in FIG. 1. This transferring section 16 includes a driving roller 27, a driven roller 28, the transport belt 29, and a transfer roller 30.

The driving roller 27 is disposed on obliquely downwardly rear side of the photosensitive drum 20 of the black processing section 15K. During the image forming process, this driving roller 27 is rotatively driven in the opposite direction of the rotation direction of the photosensitive drum 20 (counterclockwise direction in the accompanying drawing).

The driven roller 28 is disposed on obliquely downwardly front side of the photosensitive drum 20 of the yellow processing section 15Y so as to be opposed to the driving roller 27 in the anteroposterior direction. During rotative driving of this driving roller 27, the driven roller 28 is driven in the same direction of the rotation direction of the driving roller 27 (counterclockwise direction in the accompanying drawing).

The transfer belt 29 is an endless belt formed of a resin such as conductive polycarbonate and polyimide in which conductive particles such as carbon are dispersed. This transport belt 29 is wound between the driving roller 27 and the driven roller 28. The external contact surface of the transport belt 29 thus wound is disposed so as to opposingly contact all the photosensitive drums 20 of the respective processing sections 15.

When the driving roller 27 drives, the driven roller 28 is driven accordingly. The transport belt 29 orbits between the driving roller 27 and the driven roller 28 in the counterclockwise direction in the accompanying drawing.

Each of the transfer rollers 30 is disposed in opposed relation with the corresponding photosensitive drum 20 of the processing section 15 inside the transport belt 29 that is wound between the driving roller 27 and the driven roller 28 so as to sandwich the transport belt 29 between itself and the photosensitive drum 20. In each transfer roller 30, a metal roller shaft is covered with a roller portion formed of an elastic member such as an electrically conductive rubber material. The roller shaft of the transfer roller 30 extends along the width direction thereof, rotatably supported, and applied with transfer bias during transferring process. Each transfer roller 30 rotates in the same direction (counterclockwise direction in the accompanying drawing) as the orbital movement direction of the transport belt 29 on the contact surface which opposingly contacts the transport belt 29.

The sheet 3 fed from the sheet feeding section 4 is transported so that the sheet 3 sequentially passes the contact positions (transfer positions) of the transport belt 29 with the photosensitive drums 20 of the respective processing sections 15, from the front toward the back, by the transport belt 29 that orbits by driving of the driving roller 27 and the following movement of the driven roller 28. During this transportation, the toner images corresponding to the respective colors carried on the respective drum bodies 40 (see FIG. 2) of the photosensitive drums 20 of the processing sections 15 are sequentially transferred, thereby forming an color image on the sheet 3.

More specifically, for example, the yellow toner image carried on the surface of the photosensitive drum 20 of the yellow processing section 15Y, is transferred onto the sheet 3, and subsequently, the magenta toner image carried on the surface of the photosensitive drum 20 of the magenta processing section 15M, is transferred onto the sheet 3 and overlaid on the yellow toner image. With similar operation, the cyan toner image carried on the surface of the photosensitive drum 20 of the cyan processing section 15C and the black toner image carried on the surface of the photosensitive drum 20 of the black processing section 15K, are transferred and overlaid on the sheet 3, thereby forming a color image on the sheet 3.

<Fixing Section>

The fixing section 17 is disposed behind the transferring section 16 and includes a heating roller 31 and a pressure roller 32 which pressurizes the heating roller 31. In the fixing section 17, the color image transferred to the sheet 3 is thermally fixed onto the sheet 3 by application of heat and pressure during the time when the sheet 3 passes between the heating roller 31 and the pressure roller 32.

(4) Sheet Ejecting Section

The sheet ejecting section 6 includes a sheet ejecting transport path 33, a sheet ejecting roller 34, and the sheet ejecting tray 7 described above. The sheet 3 fixed with the color image is transported to the sheet ejecting transport path 33 and ejected on the sheet ejecting tray 7 by the sheet ejecting roller 34.

2. Photosensitive Drum

Figure 3:
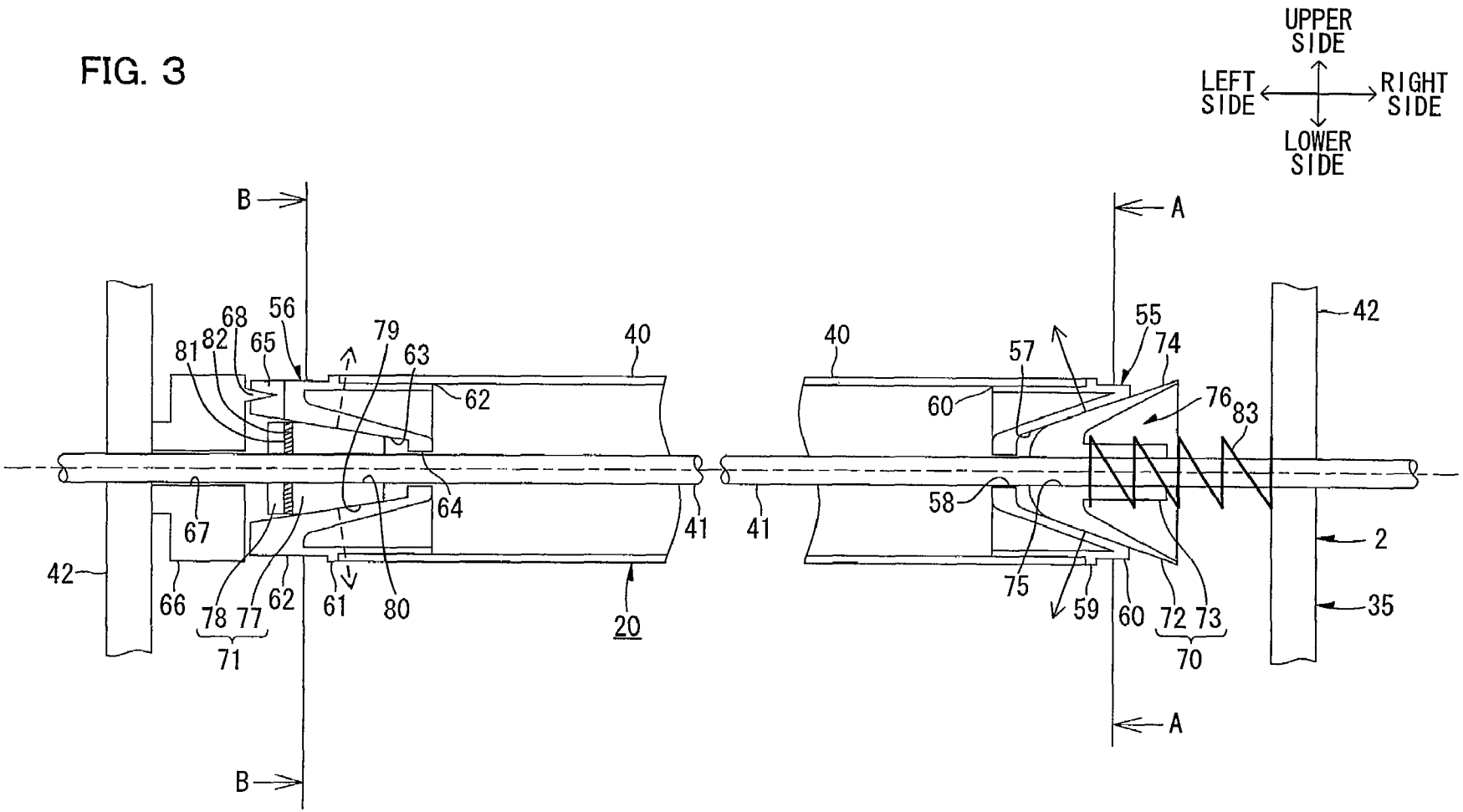
FIG. 3 is a schematic sectional view showing a photosensitive drum and a process frame supporting a drum shaft of the photosensitive drum in one processing section of the color laser printer as viewed from front.
Figure 4:
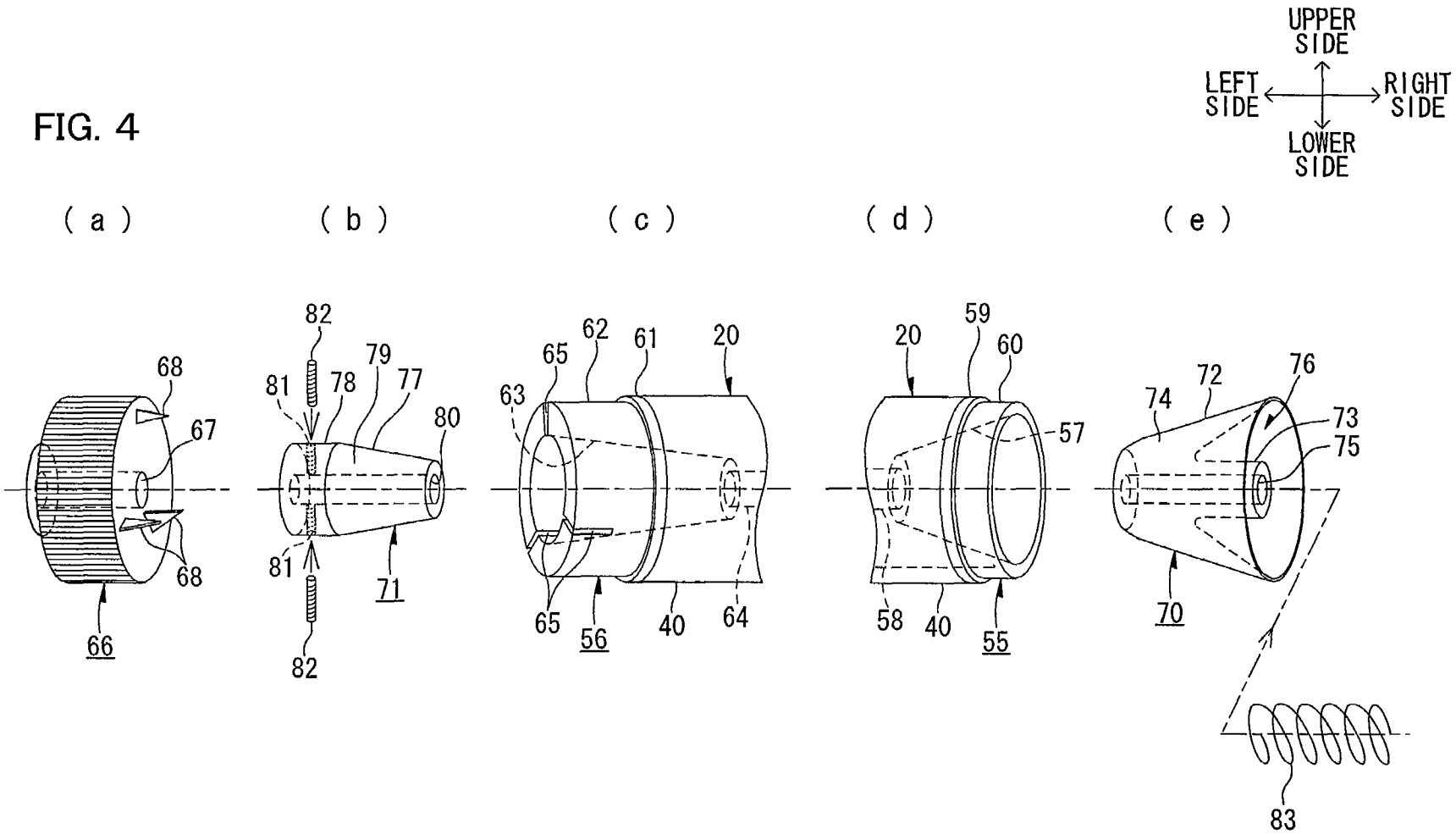
FIGS. 4(*a*) to 4(*e*) are exploded perspective views showing components in FIG. 3, where FIG.4 (*a*) shows a perspective view of a drum gear as viewed from the front right side above, FIG. 4(*b*) shows a perspective view of a positioning disk as viewed from the front right side above, FIG. 4(*c*) shows a perspective view of a drive flange as viewed from the front left side above, FIG. 4(*d*) shows a perspective view of a brake flange as viewed from the front right side above, and FIG. 4(*e*) shows a perspective view of a pressuring disk as viewed from the front right side above.

FIG. 3 is a schematic sectional view showing the photosensitive drum and the process frame supporting the drum shaft of the photosensitive drum in one processing section of the color laser printer as viewed from front. FIGS. 4(*a*) to 4(*e*) are exploded perspective views showing components in FIG. 3, where FIG. 4(*a*) shows a perspective view of a drum gear as viewed from the upper front right side, FIG. 4(*b*) shows a perspective view of a positioning disk as viewed from the upper front right side, FIG. 4(*c*) shows a perspective view of a drive flange as viewed from the upper front left side, FIG. 4(*d*) shows a perspective view of a brake flange as viewed from the upper front right side, and FIG. 4(*e*) shows a perspective view of a pressuring disk as viewed from the upper front right side.

The photosensitive drum 20 is described hereinbelow in detail.

In the photosensitive drum 20, the drum shaft 41 is unrotatably supported on the both side walls 42 of the process frame 35 and the drum body 40 is rotatably provided with respect to the drum shaft 41, as described above and as shown in FIG. 3.

<Drum Body and Surroundings>

The drum body 40 includes a brake flange 55 as an example of a brake member on the right end portion thereof in the axial (width) direction and a drive flange 56 as an example of a drive member on the left end portion thereof in the axial direction.

The brake flange 55 is formed in a hollow cylindrical shape coaxial with the drum body 40, and formed, on the external peripheral surface thereof, integrally with a cylindrical brake-side mounting surface 60 having an external diameter generally equal to the internal diameter of the drum body 40, and a flange-like brake-side positioning portion 59 (see FIG. 4(*d*)) disposed in the right side portion of the brake-side mounting surface 60 and having an external diameter generally equal to that of the drum body 40. The internal peripheral surface of the brake flange 55 is formed integrally with a conical brake-side inclined surface 57 whose diameter is gradually reduced from the right end edge of the brake flange 55 to the left and a cylindrical brake-side shaft hole 58 continuing from the left end edge of the brake-side inclined surface 57 to the left end edge of the brake flange 55 with a uniform diameter. The hole diameter of the brake-side shaft hole 58 is set to be slightly larger (by 50 μm, for example) than the shaft diameter of the drum shaft 41.

In the brake flange 55, the drum body 40 is fit onto the part of the brake-side mounting surface 60 on the left side of the brake-side positioning portion 59. The brake flange 55 is positioned with respect to the drum body 40 in the width direction since the brake-side positioning portion 59 abuts against the right end edge of the drum body 40, and the brake flange 55 is also unrotatably fitted in the drum body 40 since the part of the brake-side mounting surface 60 on the left side of the brake-side positioning portion 59 is press-fitted into the internal peripheral surface of the drum body 40.

The drive flange 56 is formed in a hollow cylindrical shape coaxial with the drum body 40, and formed, on the external peripheral surface thereof, integrally with a cylindrical drive-side mounting surface 62 having an external diameter generally equal to the internal peripheral surface of the drum body 40, and a flange-like drive-side positioning portion 61 locates generally at the center of the drive-side mounting. surface 62 in the width direction and having an external diameter generally equal to the external diameter of the drum body 40. The internal peripheral surface of the drive flange 56 is formed integrally with a conical drive-side inclined surface 63 whose diameter is gradually reduced from the left end edge of the drive flange 56 to the right, and a cylindrical drive-side shaft hole 64 continuing from the right end edge of the drive-side inclined surface 63 to the right end edge of the drive flange 56 with a uniform hole diameter. The hole diameter of the drive-side shaft hole 64 is set to be slightly larger (50 μm, for example) than the shaft diameter of the drum shaft 41. The drive flange 56 is formed on the left end surface thereof with three coupling slits 65 that are arranged at the same intervals in the circumferential direction of the drive flange 56 and notched so as to connect the external peripheral surface and the internal peripheral surface of the drive flange 56, as shown in FIG. 4(*c*).

In the drive flange 56, the drum body 40 is fit onto the part of the drive-side mounting surface 62 on the right side of the drive-side positioning portion 61, as shown in FIG. 3. The drive flange 56 is positioned with respect to the drum body 40 in the width direction since the drive-side positioning portion 61 abuts against the left end edge of the drum body 40. Further, the drive flange 56 is unrotatably fitted in the drum body 40 since the part of the drive-side mounting surface 62 on the right side of the drive-side positioning portion 61 is press-fitted into the internal peripheral surface of the drum body 40.

The drum body 40 is supported so as to freely slide and rotate with respect to the drum shaft 41 by inserting the drum shaft 41 through the brake-side shaft hole 58 of the brake flange 55 and the drive-side shaft hole 64 of the drive flange 56.

Moreover, the drive flange 56 is provided with a drum gear 66 in the left end portion thereof. Specifically, the drum gear 66 is formed in a columnar shape coaxial with the drive flange 56, and formed with gear teeth on the external peripheral surface thereof, as shown in FIG. 4(*a*). The drum gear 66 is formed, in the center of the shaft thereof, with a gear-side shaft hole 67 having a hole diameter larger than the shaft diameter of the drum shaft 41 and extending through the drum gear 66 in the width direction. Moreover, the drum gear 66 is formed with three coupling projections 68 that are formed on the right end surface of the drum gear 66, arranged in the circumferential direction of the drum gear 66 at the same intervals and protrude from the right end surface of the drum gear 66 to the right. The drive flange 56 is connected to the drum gear 66 in a relatively unrotatable manner since each coupling projection 68 is fitted in the corresponding coupling slit 65 (see FIG. 4(*c*)) in the drive flange 56, as shown in FIG. 3. As is the case with the drum body 40, the drum gear 66 is rotatably supported with respect to the drum shaft 41 by inserting the drum shaft 41 through the gear-side shaft hole 67. Moreover, although not shown, the drum gear 66 engages with the driving gear of a driving motor provided in the main body casing 2, and when a driving force of the driving motor is transmitted to the drum gear 66, the drum body 40 is rotated via the drive flange 56.

<Drum Shaft and the Surroundings>

The drum shaft 41 includes a pressuring disk 70 as an example of a pressuring member and a positioning disk 71 as an example of a positioning member respectively provided on the both lateral sides thereof, specifically at positions inwardly spaced with a predetermined distance in the width direction from the both side walls 42.

The pressuring disk 70 is formed in a generally hollow truncated cone shape coaxial with the drum shaft 41, and integrally includes a hollow cylindrical shaft receiving portion 73 that is longitudinal in the width direction and a generally truncated cone pressuring portion 72 that continues from the left end portion of the external peripheral surface of the shaft receiving portion 73 and whose diameter is gradually enlarged to the right so as to cover the external peripheral surface of the shaft receiving portion 73 in the radial direction.

The shaft receiving portion 73 is formed, in the center of the shaft thereof, with a pressuring-side shaft hole 75 having a hole diameter slightly larger than the shaft diameter of the drum shaft 41 and penetrating the shaft receiving portion 73 in the width direction.

The diameter of the external peripheral surface of the pressuring portion 72 is gradually enlarged from the left end edge to the right end edge thereof. This conical external peripheral surface is defined hereinafter as an urging-side inclined surface 74. The left end edge of the urging-side inclined surface 74 continues to the left end edge of the external peripheral surface of the shaft receiving portion 73. Moreover, the internal peripheral surface of the pressuring portion 72 is also formed in a conical shape whose diameter is gradually enlarged from the left end edge thereof to the right. In addition, the left end edge of this internal peripheral surface continues to the generally widthwise center portion of the external peripheral surface of the shaft receiving portion 73, while the right end edge of the internal peripheral surface continues to the right end edge of the external peripheral surface (urging-side inclined surface 74). The thickness of the pressuring portion 72 in the radial direction between the external peripheral surface and the internal peripheral surface are formed to be gradually thinner from the left end portion to the right end portion.

The pressuring disk 70 is formed with a circular recess 76 that recesses from the right end surface of the pressuring disk 70 to the left. The circular recess 76 is formed as a space which is defined between the internal peripheral surface of the pressuring portion 72 and the external peripheral surface of the shaft receiving portion 73, tapers to the left as seen in front section, and is formed as a circular space as seen from right side section, as shown in FIG. 4(*e*).

The drum shaft 41 is inserted through the pressuring-side shaft hole 75 of the pressuring disk 70, and the pressuring disk 70 is supported with respect to the drum shaft 41 unrotatably and slidably in the width direction on the right side of the brake-side inclined surface 57 of the brake flange 55, as shown in FIG. 3. A coil spring 83 as an example of spring which is longitudinal in the width direction, is interposed between the pressuring disk 70 and the right side wall 42. Specifically, the drum shaft 41 is inserted through the coil spring 83, the generally left half portion of the coil spring 83 is fit onto the shaft receiving portion 73 of the pressuring disk 70 SO as to be accommodated in the circular recess 76, and the right end portion of the coil spring 83 abuts against the right side wall 42. This allows the pressuring disk 70 to be always urged to the left by the coil spring 83. Since the pressuring disk 70 is thus urged to the left by the coil spring 83, the urging-side inclined surface 74 of the pressuring disk 70 is brought into surface-contact with the brake-side inclined surface 57 of the brake flange 55. The pressuring disk 70 and the coil spring 83 serve as an examples of an urging members.

The positioning disk 71 integrally includes a positioning portion 77 formed in a generally hollow truncated cone shape coaxial with the drum shaft 41, and a shaft fixing portion 78 located on the left side of the positioning portion 77 and formed in a columnar shape coaxial with the drum shaft 41.

The diameter of the external peripheral surface of the positioning portion 77 is gradually reduced from the left end edge toward the right end edge thereof. This conical external peripheral surface is defined hereinafter as a positioning-side inclined surface 79. The right end edge of the external peripheral surface of the shaft fixing portion 78 continues to the left end edge of the external peripheral surface of the positioning portion 77.

The positioning disk 71 is formed, in the center of the shaft thereof, with a positioning-side shaft hole 80 having a hole diameter slightly larger than the shaft diameter of the drum shaft 41 such that the positioning-side shaft hole 80 extends through the positioning portion 77 and the shaft fixing portion 78 in the width direction. The shaft fixing portion 78 is formed with two screw holes 81 which extend through the shaft fixing portion 78 from the external peripheral surface thereof to the positioning-side shaft hole 80 in the radial direction, as shown in FIG. 4(*b*). Each screw hole 81 is threaded on the internal peripheral surface thereof.

In the positioning disk 71, the drum shaft 41 is inserted through the positioning-side shaft hole 80, as shown in FIG. 3. Each screw 82 is screwed in the corresponding screw hole 81, and abuts against the drum shaft 41, thereby allowing the positioning disk 71 to be positioned unrotatably with respect to the drum shaft 41 and to be positioned between the drive-side inclined surface 63 of the drive flange 56 and the drum gear 66 in the width direction.

As described above, when the pressuring disk 70 is urged to the left by the coil spring 83, the urging force of the coil spring 83 is also applied on the brake flange 55 having the brake-side inclined surface 57 which is surface-contacted by the urging-side inclined surface 74 of the pressuring disk 70, the drum body 40 and the drive flange 56, thereby urging the drive flange 56 to the left, and allowing the drive-side inclined surface 63 of the drive flange 56 to be brought into surface-contact with the positioning-side inclined surface 79 of the positioning disk 71.

3. Operations and Effects

In such a color laser printer 1, the urging force of the coil spring 83 allows the urging-side inclined surface 74 of the pressuring disk 70 to surface-contact the brake-side inclined surface 57 of the brake flange 55, and allows the drive-side inclined surface 63 of the drive flange 56 to surface-contact the positioning-side inclined surface 79 of the positioning disk 71.

When the developing roller 24 (see FIG. 2) and the drum body 40 are rotated during image formation process, the rotating torque that corresponds to the aforementioned rotational speed difference between the drum body 40 and the developing roller 24, acts on the rotation of the drum body 40. At this time, the brake-side inclined surface 57 of the brake flange 55 that rotates together with the drum body 40 is in sliding contact with the urging-side inclined surface 74 of the pressuring disk 70 while the drive-side inclined surface 63 of the drive flange 56 that rotates together with the drum body 40 is in sliding contact with the positioning-side inclined surface 79 of the positioning disk 71. Accordingly, the frictional forces are applied to the rotation of both the brake flange 55 and the drive flange 56, respectively, to cancel out the rotating torque described above. In addition, these frictional forces restrain the change in the rotational speed of the drum body 40 due to the backlash between the drum gear 66 and the driving gear (not shown) of the driving motor (not shown) in the main body casing 2 described above that engage with each other. This mechanism can maintain the constant-speed rotation of the drum body 40.

Further, the brake-side inclined surface 57 and the urging-side inclined surface 74 incline along the drum shaft 41, so that the contact area therebetween is greater compared with that in the case where these inclined surfaces are orthogonal to the drum shaft 41, whereby the frictional force applied to the rotation of the brake flange 55 described above can be relatively increased. Further, since the brake-side inclined surface 57 and the urging-side inclined surface 74 are both inclined surfaces, the relative positions of these inclined surfaces can be prevented from shifting in the direction (radial direction) orthogonal to the drum shaft 41, compared with the case where these inclined surfaces are orthogonal to the drum shaft 41. As a result, the urging-side inclined surface 74 can be surface-contacted with the brake-side inclined surface 57 in a stable manner.

Further, as is the case with the brake-side inclined surface 57 and the urging-side inclined surface 74, the drive-side inclined surface 63 and the positioning-side inclined surface 79 incline along the drum shaft 41, so that the frictional force applied to the rotation of the drive flange 56 described above can also be relatively increased. As a result, the drive-side inclined surface 63 can be surface-contacted with the positioning-side inclined surface 79 in a stable manner.

Figure 5:
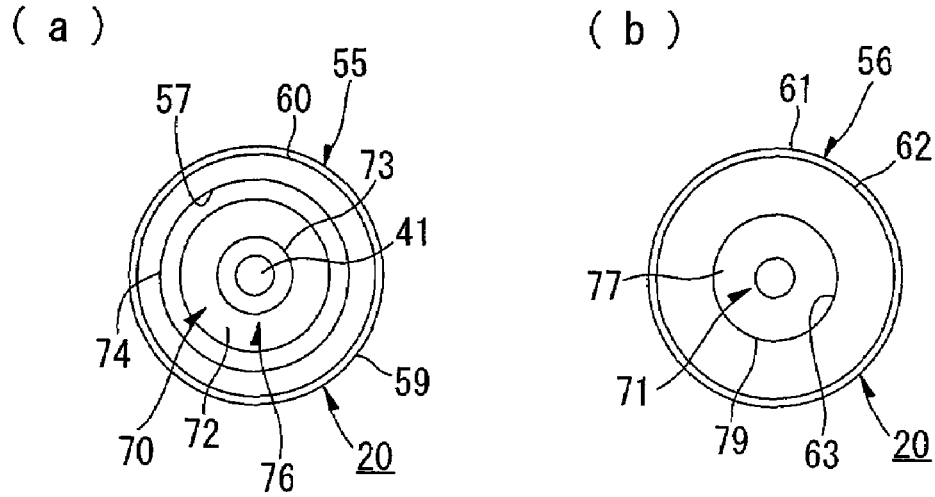
FIG. 5(*a*) is a view taken along a line A-A viewed in an arrow direction A in FIG. 3 and FIG. 5(*b*) is a view taken along a line B-B viewed in an arrow direction B in FIG. 3.

FIG. 5(*a*) is a view taken along the cutting line A-A viewed in an arrow direction A in FIG. 3, and FIG. 5(*b*) is a view taken along cutting the line B-B viewed in an arrow direction B in FIG. 3.

As shown in FIG. 3, the urging force of the coil spring 83 described above acts on the brake flange 55 in a direction orthogonal to the brake-side inclined surface 57 (see the illustrated arrow with a solid line) at a surface-contact portion between the urging-side inclined surface 74 and the brake-side inclined surface 57. Since the surface-contact portion is inclined, this urging force is divided into a component force toward the left side in the shaft (width) direction of the drum shaft 41 (defined hereinafter as an axial urging force), and a component force toward the outside in the radial direction of the drum shaft 41 (defined hereinafter as a radial urging force). In particular, the radial urging force of these component forces functions for restricting the movement of the drum body 40 in the axial direction, and acts uniformly along the entire periphery of the surface-contact portion between the urging-side inclined surface 74 and the brake-side inclined surface 57 (see FIG. 5(*a*)), so that the frictional force described above can be applied uniformly to the rotation of the brake flange 55 in the rotation direction thereof, thereby reducing the eccentric rotation of the drum body 40 and restricting generation of slight vibration of the drum body 40 which may be caused by shift of the drum body 40 from the rotation center due to the centrifugal force when the drum body 40 is rotated, compared with the case where the surface-contact portion is orthogonal to the drum shaft 41.

Moreover, when the urging force of the coil spring 83 brings the drive-side inclined surface 63 into surface-contact with the positioning-side inclined surface 79, the reaction force from the positioning disk 71 against the urging force acts on the drive flange 56. This reaction force acts on the drive flange 56 in a direction orthogonal to the drive-side inclined surface 63 (see the illustrated arrow with a dashed line) on the surface-contact portion between the positioning-side inclined surface 79 and the drive-side inclined surface 63. This reaction force is divided into a component force toward the right side in the shaft (width) direction of the drum shaft 41 (defined hereinafter as an axial reaction force), and a component force toward the outside in the radial direction of the drum shaft 41 (defined hereinafter as a radial reaction force). The radial reaction force acts uniformly along the entire periphery of the surface-contact portion between the positioning-side inclined surface 79 and the drive-side inclined surface 63 (see FIG. 5(*b*)), so that the frictional force described above can be applied uniformly to the rotation of the drive flange 56 in the rotation direction thereof, thereby reducing the eccentric rotation of the drum body 40.

Accordingly, with simple configuration, the constant-speed rotation of the drum body 40 can reliably be maintained and the image shift can reliably be prevented.

Moreover, as described above, since the axial urging force acts to the left and the axial reaction force acts to the right, the axial urging force and the axial reaction force cancel each other out. In addition, as described above, since the radial urging force acts on the brake flange 55 uniformly along the entire periphery of the surface-contact portion between the urging-side inclined surface 74 and the brake-side inclined surface 57, and the radial reaction force acts on the drive flange 56 uniformly along the entire periphery of the surface-contact portion between the positioning-side inclined surface 79 and the drive-side inclined surface 63, the brake flange 55 and the drive flange 56 are positioned in the radial direction. Therefore, the drum body 40 can be positioned in both the axial direction and the radial direction of the drum shaft 41 at the same time.

Additionally, the urging member for generating the urging force as described above can be simply configured by the coil spring 83 and the pressuring disk 70. Further, in the pressuring disk 70, a right end surface thereof pressed by the coil spring 83 recesses toward the downstream side in the pressing direction (to the left) and a generally left half portion of the coil spring 83 is accommodated in the recessed portion as the circular recess 76, thereby the recessed portion is effectively used, whereby downsizing of the color laser printer 1 can be achieved.

In addition, the plurality of processing sections 15 each having the photosensitive drum 20 of such configuration can be together detached from and attached to the main body casing 2 in a slidable manner, thereby improving the operability. Moreover, the attaching and detaching of the processing section 15 involves attaching and detaching of the corresponding developer cartridge 22, thereby achieving further improvement of the operability.

Thus, the color laser printer 1 having the plurality of processing sections 15 can achieve image formation with a plurality of colors while reliably preventing the image shift during the image formation.

Second Embodiment

Figure 6:
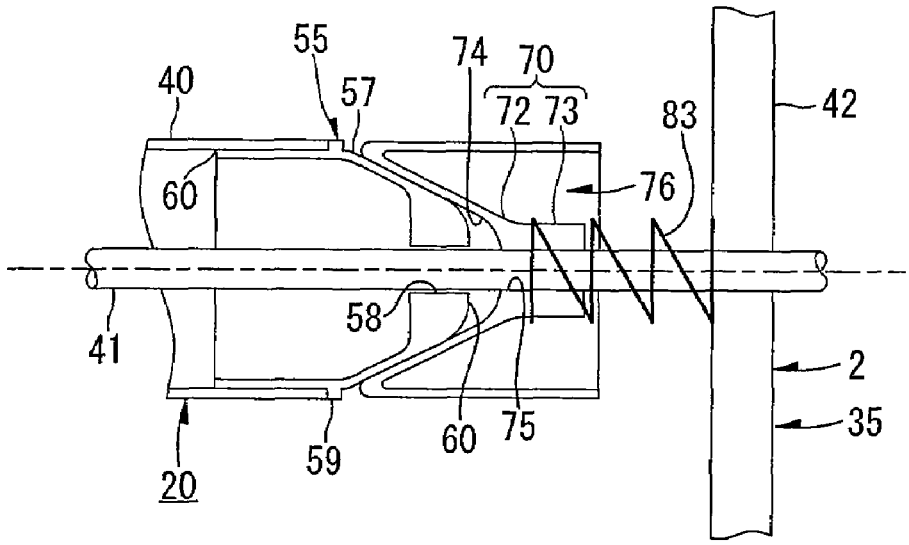
FIG. 6 shows a brake-side inclined surface and an urging-side inclined surface whose diameters are gradually enlarged from the right side toward the left side in FIG. 3.

FIG. 6 shows a brake-side inclined surface and an urging-side inclined surface whose diameters are gradually enlarged from the right to the left in FIG. 3.

The brake-side inclined surface 57 and the urging-side inclined surface 74 are formed such that the diameters thereof are reduced from the right to the left, that is, toward the urging direction of the coil spring 83, as shown in FIG. 3. However, these diameters maybe formed to be gradually enlarged from the right to the left, as shown in FIG. 6. More specifically, in the brake flange 55, the brake-side inclined surface 57 is formed by the brake-side mounting surface 60, not by the internal peripheral surface of the brake flange 55, and is formed by gradually reducing the diameter of the portion of the brake-side mounting surface 60 on the right side of the brake-side positioning portion 59 to the right. Moreover, in the pressuring disk 70, the pressuring portion 72 has a diameter that gradually enlarges from the left end portion of the external peripheral surface of the shaft receiving portion 73 continuously to the left until it reaches a diameter equal to the diameter of the brake-side positioning portion 59 and, then extends to the right with the same diameter. On the other hand, the urging-side inclined surface 74 is formed with the internal peripheral surface of a portion of the pressuring portion 72 whose diameter enlarges continuously from the left end portion of the external peripheral surface of the shaft receiving portion 73 to the left. The circular recess 76, which accommodates the coil spring 83, is defined between the portion of the internal peripheral surface of the pressuring portion 72 extending to the right with the diameter equal to that of the brake-side positioning portion 59 and the external peripheral surface of the shaft receiving portion 73.

Also in this case, the image shift prevention effect described above can be achieved. By reducing or enlarging the diameter along the urging direction of the coil spring 83 from the right to the left, the coil spring 83 can efficiently act the urging force on the surface-contact between the brake-side inclined 57 and the urging-side inclined surface 74.

Third Embodiment

Figure 7:
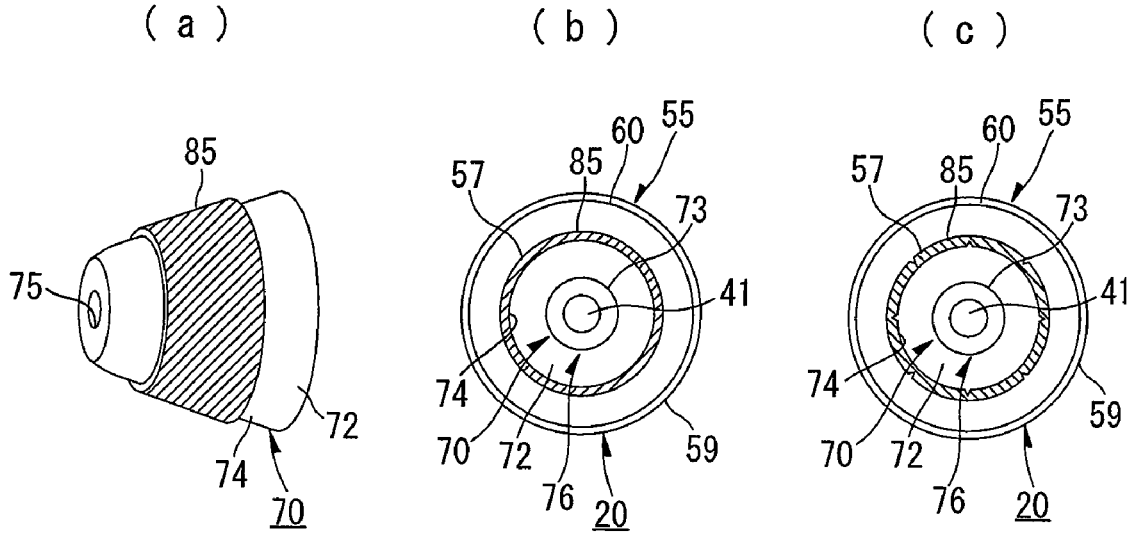
FIG. 7(*a*) to 7(*c*) show the pressuring disk provided with a friction member along the entire periphery of the urging-side inclined surface, where FIG. 7(*a*) shows a perspective view as viewed from the front left side above, FIG. 7(*b*) shows a view taken along the line A-A viewed in the arrow direction A in FIG. 3 when this pressuring disk is applied, and FIG. 7(*c*) shows a case where the brake-side inclined surface and the urging-side inclined surface in FIG. 7(*b*) have recesses and convexes on the periphery thereof.

FIGS. 7(*a*) to 7(*c*) show a pressuring disk provided with a friction member along the entire periphery of the urging-side inclined surface, where FIG. 7(*a*) shows a perspective view as viewed from front left side above, FIG. 7(*b*) shows a view taken along the cutting line A-A viewed in the arrow direction A in FIG. 3 when this pressuring disk is applied, and FIG. 7(*c*) shows the case where the brake-side inclined surface and the urging-side inclined surface in FIG. 7(*b*) have recesses and convexes on the peripheries thereof.

As shown in FIG. 7(*a*), a friction member 85 (a diagonally shaded portion shown in the drawing) is provided along the entire periphery of the urging-side inclined surface 74 of the pressuring disk 70. The friction member 85 is formed of the material that has flexibility and a more rough surface compared with the urging-side inclined surface 74 and the brake-side inclined surface 57, such as unwoven cloth, cork, and the like. Since the friction member 85 is provided in the manner described above, the urging-side inclined surface 74 does not contact directly the brake-side inclined surface 57, but the friction member 85 provided on the urging-side inclined surface 74 contacts the brake-side inclined surface 57, as shown in FIG. 7(*b*). Along with the rotation of the brake flange 55, the brake-side inclined surface 57 is in sliding contact with the friction member 85 and it is possible to apply a greater frictional force to the rotation of the brake flange 55 compared with that in the case where the brake-side inclined surface 57 is in sliding contact with the urging-side inclined surface 74 (see FIG. 5(*a*)), thereby more reliably maintaining the constant-speed rotation of the drum body 40. Further, as described above, since the friction member 85 is provided across the entire portion (entire circumference) of the urging-side inclined surface 74, a frictional force can be reliably applied to the rotation of the brake flange 55.

Moreover, since the friction member 85 has flexibility as described above, the flexibility allows the friction member 85 to follow the recesses and the convexes on the surface-contact portion between the brake-side inclined surface 57 and the urging-side inclined surface 74, as shown in FIG. 7(*c*). This ensures reliable application of the frictional force to the rotation of the brake flange 55, thereby more reliably maintaining the constant-speed rotation of the drum body 40. Additionally, the recesses and convexes on the brake-side inclined surface 57 and the urging-side inclined surface 74, that is, the manufacturing tolerance, can be allowed, thereby leading to the reduction in manufacturing costs.

As described above and shown in FIG. 3, in the pressuring disk 70, the thickness of the pressuring portion 72 in the radial direction between the external peripheral surface and the internal peripheral surface of the pressuring portion 72 is formed to become gradually thinner from the left end portion to the right end portion, so that a flexibility can be provided to this thin portion. Therefore, as is the case with the friction member 85, the frictional force can be reliably applied to the rotation of the brake flange 55, thereby more reliably maintaining the constant-speed rotation of the drum body 40.

Separately from this friction member 85 provided on the urging-side inclined surface 74 as described above and shown in FIG. 7, the friction member 85 may be provided on the brake-side inclined surface 57, or the friction members 85 may be provided on both the urging-side inclined surface 74 and the brake-side inclined surface 57. Alternatively, as is the case with the urging-side inclined surface 74 and the brake-side inclined surface 57, the friction member(s) 85 may be provided on the drive-side inclined surface 63 and/or the positioning-side inclined surface 79.

Figure 8:
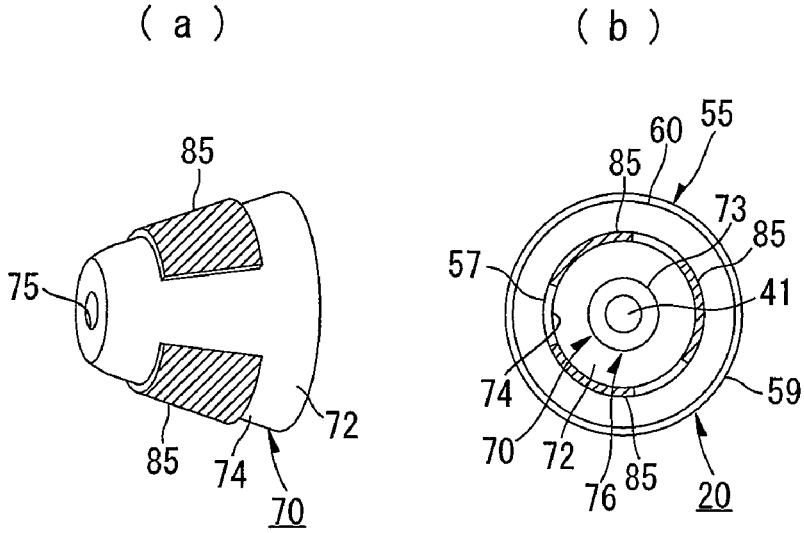
FIG. 8(*a*) and 8(*b*) show the pressuring disk equidistantly provided with friction members on the periphery of the urging-side inclined surface, where FIG. 8(*a*) shows a perspective view as viewed from the front left side above, and FIG. 8(*b*) shows a view taken along the line A-A viewed in the arrow direction A in FIG. 3 when this pressuring disk is applied.

FIGS. 8(*a*) and 8(*b*) show a pressuring disk provided with friction members on the periphery of the urging-side inclined surface at the same intervals, where FIG. 8(*a*) shows a perspective view as viewed from the front left side above, and FIG. 8(*b*) shows a view taken along the cutting line A-A viewed in the arrow direction A in FIG. 3 when this pressuring disk is applied.

The friction member 85 is provided along the entire periphery of the urging-side inclined surface 74 in FIG. 7, however, a plurality of the friction members 85 may be provided on the periphery of the urging-side inclined surface 74 at the same intervals, as shown in FIG. 8. More specifically, in FIG. 8, three friction members 85 are provided with displacement of approximately 120-degree angle on the periphery of the urging-side inclined surface 74. The friction member 85 has a length in the circumferential direction corresponds to generally one-fifth of the length of the urging-side inclined surface 74 in the circumferential direction. With this arrangement, appropriate magnitude of a frictional force can be uniformly applied to the rotation of the brake flange 55 along the rotation direction. This can allow an extra friction member 85 to be omitted and reliably maintain the constant-speed rotation of the drum body 40 while reducing manufacturing costs.

Figure 9:
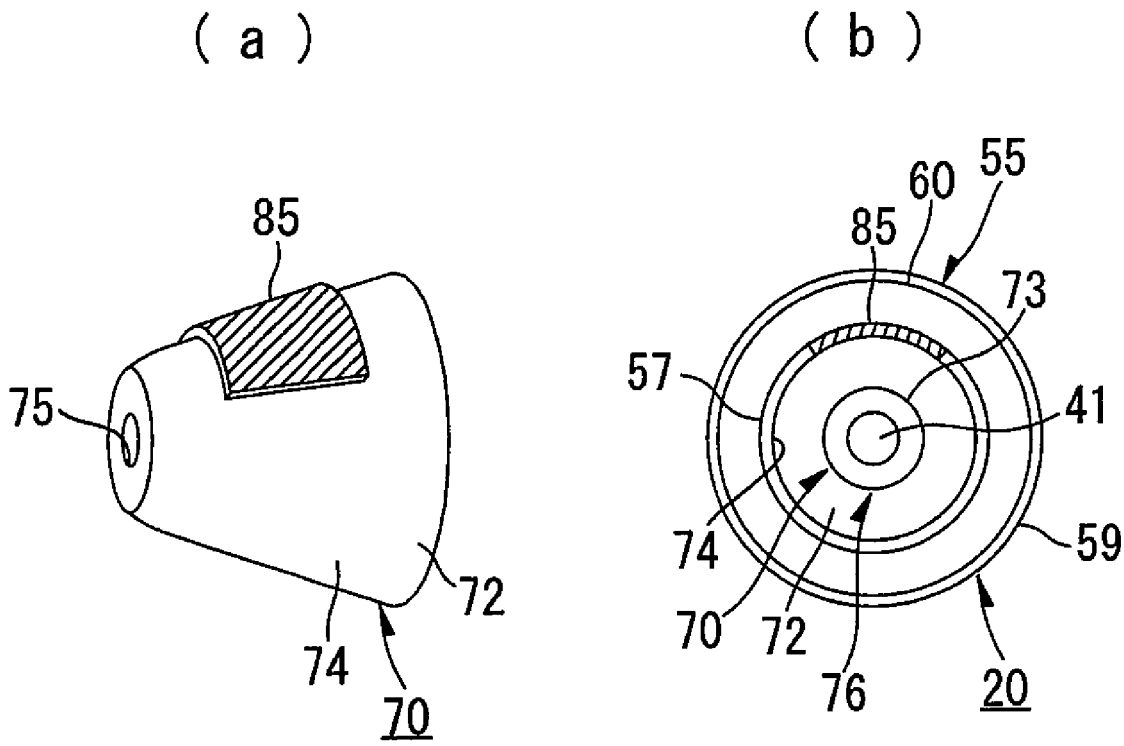
FIGS. 9(*a*) and 9(*b*) show a pressuring disk in which a friction member is provided on a portion of the circumference of the urging-side inclined surface, where FIG. 9(*a*) shows a perspective view as viewed from the front left side above, and FIG. 9(*b*) shows a view taken along the line A-A viewed in the arrow direction A in FIG. 3 when this pressuring disk is applied.

FIGS. 9(*a*) and 9(*b*) show a pressuring disk in which a friction member is provided on a portion of the circumference of the urging-side inclined surface, where FIG. 9(*a*) shows a perspective view as viewed from the front left side above, and FIG. 9(*b*) shows a view taken along the line A-A viewed in the arrow direction A in FIG. 3 when this pressuring disk is applied.

As shown in FIGS. 9(*a*) and 9(*b*), the friction member 85 may be provided on a position of the circumference of the urging-side inclined surface 74. That is, the three friction members 85 provided in FIG. 8 are reduced to one friction member 85. Accordingly, the brake-side inclined surface 57 and the urging-side inclined surface 74 are surface-contacted to each other only at a circumferential portion. Therefore, only at a circumferential portion, the drum body 40 can be pressed in the radial direction, by the above-mentioned urging force in the radial direction (radial urging force). Accordingly, for example, when this circumferential portion is set as the contact position between the drum body 40 and the sheet 3, the urging force (radial urging force) of the coil spring 83 is concentrated on this portion, and the drum body 40 can be reliably pressed against the sheet 3. Further, a direction in which the drum body 40 is pressed can be freely set by changing the circumferential position of the friction member 85.

The friction member 85 may be provided on a portion of the circumference of the brake-side inclined surface 57. Alternatively, the friction member 85 may be provided on a portion of the circumference of the drive-side inclined surface 63 or the positioning-side inclined surface 79.

Alternatively, instead of providing the friction member 85 on the urging-side inclined surface 74 or the brake-side inclined surface 57, a coarse surface (rough surface) may be formed on a part or the whole of the urging-side inclined surface 74 and the brake-side inclined surface 57. Thus, as is the case with the friction member 85, a greater frictional force can be applied to the rotation of the brake flange 55 compared with that in the case where the frictional force is generated by above-described sliding contact, whereby the constant-speed rotation of the drum body 40 can be more reliably maintained. Alternatively, the rough surface may be formed on either one of the drive-side inclined surface 63 or the positioning-side inclined surface 79, or both of the drive-side inclined surface 63 and the positioning-side inclined surface 79.

Fourth Embodiment

Although each embodiment has been illustrated hereinabove as a tandem type color laser printer 1 which transfers the image directly from the photosensitive drum 20 onto the sheet 3, the present invention is not limited thereto, and the invention may be configured as an intermediate transfer type color laser printer which temporarily transfers the toner image of each color from each photosensitive body to the intermediate transfer body and then transfers the images onto the sheet 3 at a time, or further, the invention maybe configured as a monochrome laser printer. The monochrome laser printer may include a processing unit as an image forming unit, in which one developer cartridge 22 is attached in one processing section 15.

Fifth Embodiment

Figure 10:
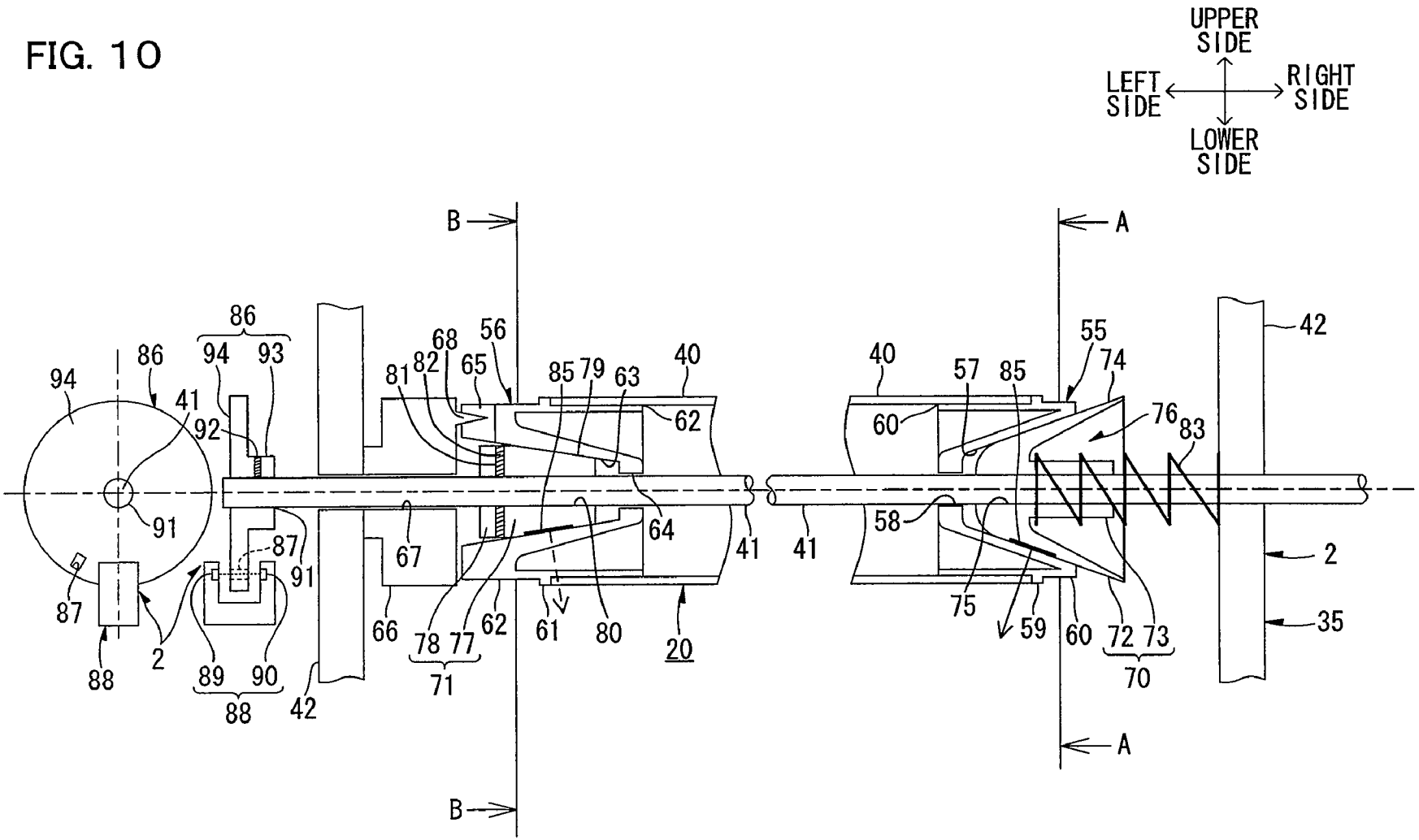
FIG. 10 shows a state where a shaft gear is provided on an end portion of the drum shaft in FIG. 3.

FIG. 10 shows a state where a shaft gear is provided on an end portion of the drum shaft in FIG. 3. FIG. 10 also shows the left side view in the vicinity of the shaft gear for the convenience of explanation.

In each processing section 15, a shaft gear 86 is provided on the left end portion of the drum shaft 41 (specifically, a portion leftward of the left side wall 42). The shaft gear 86 integrally includes a small diameter portion 93 in a columnar shape and a large diameter portion 94 in a disk shape in this order from the right. A circle center position of the shaft gear 86 is formed with a shaft-side axial hole 91 penetrating the shaft gear 86 in the width direction and having generally the same diameter as that of the drum shaft 41. The drum shaft 41 is inserted through the shaft-side axial hole 91. The small diameter portion 93 is fixed to the drum shaft 41 by a screw 92, and the shaft gear 86 is rotatable together with the drum shaft 41, the pressuring disk 70 and the positioning disk 71. The drum body 40 and the drum gear 66 are rotatable with respect to the drum shaft 41, as in the above example. Gear teeth are formed on an outer circumferential surface of the large diameter portion 94, and the gear teeth are meshed with a main body gear (not shown) of the main body casing 2. A passing hole 87 penetrating the large diameter portion 94 in the width direction is formed in a circumferential portion of the peripheral edge portion of the large diameter portion 94.

The friction member 85 is provided on each one circumferential portion of the urging-side inclined surface 74 of the pressuring disk 70 and the positioning-side inclined surface 79 of the positioning disk 71 (see FIGS. 9(*a*) and 9(*b*)). Specifically, the each friction member 85 is disposed on the each lower end position of the urging-side inclined surface 74 and the positioning-side inclined surface 79. Accordingly, as described above, the above-mentioned radial urging force (the above-mentioned radial reaction force, in case of the positioning-side inclined surface 79) concentrates on the circumferential portion where the friction member 85 is positioned. Therefore, the drum body 40 is pressed in a predetermined radial direction (against the transport belt 29 and the sheet 3 below the friction member 85, in this case) at this circumferential portion.

Further, the main body casing 2 is provided with light sensors 88 corresponding to the respective processing sections 15. The light sensor 88 is in a U-shape as seen in section, and this U-shape has a bottom fixed to the main body casing 2 and two end portions to which a light emitting portion 89 and a light receiving portion 90 are respectively provided in a widthwise opposed spaced relation to each other. A part of the peripheral edge portion of the large diameter portion 94 is disposed between the light emitting portion 89 and the light receiving portion 90 which are opposed to each other. In the light sensor 88, when the passing hole 87, the light emitting portion 89 and the light receiving portion 90 are widthwise aligned, a detection light (see the dotted line in the figure) emitted from the light emitting portion 89 along the width direction passes through the passing hole 87 and is received at the light receiving portion 90. The position of the shaft gear 86 at this time is used as a reference position.

A CPU(not shown) controls a driving source of the main body gear (not shown) so that the shaft gear 86 moves from this detected reference position by a desired predetermined amount. In other words, the CPU (not shown) performs the control so that the circumferential position of the friction members 85 provided on the respective circumferential position of the urging-side inclined surface 74 and the positioning-side inclined surface 79 (still more specifically, the pressing direction of the drum body 40 corresponding to the circumferential position of the friction members 85) is desirable position. As a control method, for example, the reference position of the shaft gear 86 is detected, and the driving source of the main body gear is driven from the reference position by a pulse whose number corresponds to the desired moving amount.

Accordingly, since the corresponding shaft gear 86 can be appropriately rotated, the circumferential position of the friction member 85 can be controlled and the pressing direction of the drum body 40 can be freely changed. As a result, for example, the pressing amount (pressing force) of the drum body 40 against the transport belt 29 and the sheet 3 can be freely changed.

The embodiments described above are illustrative and explanatory of the invention. The foregoing disclosure is not intended to be precisely followed to limit the present invention. Various modifications and alterations are possible in light of the foregoing description, and may be obtained by implementing the invention. The present embodiments are selected and described for explaining the essence and practical applicational schemes of the present invention which allow those skilled in the art to utilize the present invention in various embodiments and various alterations suitable for anticipated specific use. The scope of the present invention is to be defined by the appended claims and their equivalents.

What is claimed is:

1. A photosensitive unit comprising:

a side wall;

a drum body rotatably provided with respect to the side wall and formed with an electrostatic latent image, the drum body having one end portion and another end portion;

a brake member provided on the one end portion of the drum body in an axial direction and having a brake-side inclined surface whose diameter is gradually enlarged or reduced along the axial direction with an axis of the drum body as a center;

an urging member having an urging-side inclined surface surface-contacting the brake-side inclined surface and urging the brake member such that the urging-side inclined surface surface-contacts the brake-side inclined surface; and a positioning member having a positioning-side inclined surface, wherein the positioning-side inclined surface is surface-contacted by the another end portion of the drum body when the urging member urges the brake member.

2. The photosensitive unit according to claim 1, wherein the diameters of the brake-side inclined surface and the urging-side inclined surface are reduced toward a direction toward which the urging member urges the brake member.

3. The photosensitive unit according to claim 1, wherein the diameters of the brake-side inclined surface and the urging-side inclined surface are enlarged toward a direction toward which the urging member urges the brake member.

4. The photosensitive unit according to claim 1, wherein at least either one of the brake-side inclined surface and the urging-side inclined surface is provided with a friction member interposed between the brake-side inclined surface and the urging-side inclined surface for applying a frictional force to a rotation of the brake member.

5. The photosensitive unit according to claim 4, wherein the friction member is provided on at least a part of the brake-side inclined surface or the urging-side inclined surface.

6. The photosensitive unit according to claim 5, wherein the friction member is provided on an entire portion of the brake-side inclined surface or the urging-side inclined surface in a circumferential direction with the axis of the drum body as a center.

7. The photosensitive unit according to claim 5, wherein the friction member is provided on a portion of the brake-side inclined surface or the urging-side inclined surface in a circumferential direction with the axis of the drum body as a center.

8. The photosensitive unit according to claim 5, wherein a plurality of the friction members are provided at the same intervals on the brake-side inclined surface or the urging-side inclined surface in a circumferential direction with the axis of the drum body as a center.

9. The photosensitive unit according to claim 4, wherein the friction member has flexibility.

10. The photosensitive unit according to claim 1, wherein at least part of the brake-side inclined surface and the urging-side inclined surface are formed with a rough surface for applying a frictional force to a rotation of the brake member.

11. The photosensitive unit according to claim 1 comprising:

a drive member provided on the another end portion of the drum body in the axial direction, having a drive-side inclined surface whose diameter is gradually enlarged or reduced along the axial direction with the axis of the drum body as a center, and transmitted with a driving force for rotating the drum body and the brake member, wherein the positioning member surface contacts the drive-side inclined surface.

12. The photosensitive unit according to claim 1, wherein the urging member comprises:

a spring for generating an urging force; and a pressuring member formed with the urging-side inclined surface and bringing the urging-side inclined surface into surface-contact with the brake-side inclined surface when pressed by the spring.

13. The photosensitive unit according to claim 12, wherein the pressuring member is recessed to a downstream side in a pressing direction of the spring so as to accommodate the spring in a portion pressed by the spring.

14. The photosensitive unit according to claim 13, wherein a thickness of the pressuring member in radial direction with the axis of the drum body as a center is thinner on an upstream side compared with the downstream side in the pressing direction of the spring.

15. The photosensitive unit according to claim 1, being detachably mountable to an image forming apparatus body.

16. The photosensitive unit according to claim 15, comprising a developing unit for forming a developing agent image by feeding a developing agent to the drum body and developing the electrostatic latent image.

17. The photosensitive unit according to claim 1, comprising a plurality of the drum bodies, a plurality of the brake members and a plurality of the urging members in a direction orthogonal to the axial direction of the drum body, the plurality of drum bodies, the plurality of brake members and the plurality of urging members are together attached to and detached from an image forming apparatus body in a slidable manner.

18. The photosensitive unit according to claim 17, comprising a plurality of developing units corresponding to the respective drum bodies, the developing unit forming a developing agent image by feeding the developing agent to the drum body and developing the electrostatic latent image.

19. An image forming apparatus comprising:

an image forming apparatus body;

a photosensitive unit being detachably mountable to the image forming apparatus body and comprising a side wall, a drum body rotatably provided with respect to the side wall and formed with an electrostatic latent image, the drum body having one end portion and another end portion, a brake member provided on the one end portion of the drum body in an axial direction and having a brake-side inclined surface whose diameter is gradually enlarged or reduced along the axial direction with an axis of the drum body as a center, an urging member having an urging-side inclined surface surface-contacting the brake-side inclined surface and urging the brake member such that the urging-side inclined surface surface-contacts the brake-side inclined surface, a positioning member having a positioning-side inclined surface, wherein the positioning-side inclined surface is surface-contacted by the another end portion of the drum body when the urging member urges the brake member, and a developing unit for forming a developing agent image by feeding a developing agent to the drum body and developing the electrostatic latent image;

a transferring unit for transferring the developing agent image carried on the drum body and developed by the developing unit onto a transfer medium; and a fixing unit for fixing the developing agent image transferred onto the transfer medium on the transfer medium.

20. An image forming apparatus comprising:

an image forming apparatus body;

a photosensitive unit comprising a side wall, a drum body rotatably provided with respect to the side wall and formed with an electrostatic latent image, the drum body having one end portion and another end portion, a brake member provided on the one end portion of the drum body in an axial direction and having a brake-side inclined surface whose diameter is gradually enlarged or reduced along the axial direction with an axis of the drum body as a center, an urging member having an urging-side inclined surface surface-contacting the brake-side inclined surface and urging the brake member such that the urging-side inclined surface surface-contacts the brake-side inclined surface, a positioning member having a positioning-side inclined surface, wherein the positioning-side inclined surface is surface-contacted by the another end portion of the drum body when the urging member urges the brake member, and a developing unit for forming a developing agent image by feeding a developing agent to the drum body and developing the electrostatic latent image;

a transferring unit for transferring the developing agent image carried on the drum body and developed by the developing unit onto a transfer medium; and a fixing unit for fixing the developing agent image transferred onto the transfer medium on the transfer medium, wherein the photosensitive unit comprises: a plurality of the drum bodies, a plurality of the brake members and a plurality of the urging members in a direction orthogonal to the axial direction of the drum body; and the photosensitive unit comprises a plurality of the developing units corresponding to the respective drum bodies, and the plurality of drum bodies, the plurality of brake members and the plurality of urging members are together attached to and detached from the image forming apparatus body in a slidable manner.

* * * * *